US005572196A

United States Patent [19]

Sakumoto et al.

[11] Patent Number: 5,572,196

[45] Date of Patent: Nov. 5, 1996

[54] ELECTRONIC ANALOG WATCH WITH PAGER

[76] Inventors: Kazumi Sakumoto; Fugio Ozawa, both of 31-1, Kameido 6-chome, Koto-ku, Tokyo, Japan

[21] Appl. No.: 83,014

[22] Filed: Jun. 23, 1993

[30] Foreign Application Priority Data

May 10, 1993 [JP] Japan ..... 5-108432

[51] Int. Cl.[6] ..... G08B 5/22; G04B 47/00

[52] U.S. Cl. ..... 340/825.44; 368/10; 368/228

[58] Field of Search ..... 340/825.44, 825.47; 368/88, 223, 228, 232, 10

[56] References Cited

U.S. PATENT DOCUMENTS

| | | | |
|---|---|---|---|
| 4,713,808 | 12/1987 | Gaskill et al. | 340/825.44 |
| 4,845,485 | 7/1989 | Pace | 368/10 |
| 5,297,118 | 3/1994 | Sakumoto | 368/10 |

OTHER PUBLICATIONS

Motorola Watch Pager, 1990, Paging Division, 1500 NW 22nd Ave, Boynton Beach, FL 33426–8292 (6 pages).

*Primary Examiner*—Donald J. Yusko

*Assistant Examiner*—Edward Merz

[57] ABSTRACT

An electronic analog timepiece provided with a pager is not only excellent from design and fashion standpoints, but is capable of displaying information such as a call signal or alarm, a caller's number or identity, identification number, telephone number or the like on the analog watch display. On the basis of an output signal of an external inputting element or switch, or on the basis of an output signal of a timer, an output of one of a received message information storing circuit or a time measuring circuit is chosen for display by a display switching circuit. The signal selected for display is input to an analog display unit. Further, the output signal of the external inputting switch or timer circuit is input to the received information storing circuit to control the received information. Thus, the analog display can be utilized for the display of time and paging signals. Prestored display hand pattern data can be accessed when necessary to effectuate various display hand sequence patterns to indicate various messages.

25 Claims, 16 Drawing Sheets

ELECTRONIC ANALOG WATCH WITH PAGER

BACKGROUND OF THE INVENTION

The present invention relates to an electronic analog watch provided with a pager for receiving a call signal and for informing the user of the received call via an analog display.

The conventional pager will be described hereinbelow with reference to FIG. 16. When a call number of a person required to be called is inputted to a telephone, the call signal thereof is given to a radio paging station through a telephone network and then transmitted therefrom. A high frequency receiving element 1 of the pager receives the call signal and then outputs the received call to a signal demodulating circuit 2. The received call signal is demodulated by the signal demodulating circuit 2 into a digital signal, and then stored in a received information storing circuit 3. A call number comparing circuit 4 compares the received call signal stored in the received information storing circuit 3 with a plurality of call numbers previously stored in a call number storing circuit 6. When the comparison results match each other, an alarm element 5 generates an alarm such as sound, light, vibration, etc. to inform the user of the incoming call.

Recently, there has been widely used such a pager that when a caller inputs his identification number or his message (e.g., a telephone number) after a call signal, the caller identifying number and the message can be displayed on an LCD (liquid crystal display) panel section, in addition to the generation of an alarm for indicating call reception. Further, a pager small in size and light in weight has been more and more popular by the users.

Therefore, a watch type pager excellent in portability has been proposed. However, the watch type pager so far proposed is a digital display type pager, because the amount of information is large.

On the other hand, however, the analog display watches are greater than the digital display watches (including only digital display function) in the amount of both sale and production. This is because the analog display watches are more suitable for users' demand from the design and fashion standpoints.

Consequently, an analog display watch provided with pager function has been proposed. In the conventional analog display watch provided with pager function, however, the function is only to receive a call signal and to inform the user of the call reception, thus involving a problem in that it is impossible to acquire other information.

SUMMARY OF THE INVENTION

The object of the present invention is to provide an electronic analog watch provided with a pager which can display various information such as a caller identifying number, a telephone number, etc. in addition to a call alarm, in the form of the analog watch which is excellent from design and fashion standpoints.

To solve the above-mentioned problems, in the present invention, on an basis of the output signal of the external inputting means or timer means, the an time signal outputted by the time measuring means and received information signal outputted by received information storing means are selected by display switching means. The output of the display switching means is inputted to analog display means.

Further, the output signal of the external inputting means or the timer means is inputted to the received information storing means to control the received information to be displayed. The output signal of the received information storing means is inputted to the pager information analog display means for displaying only the received pager information.

In the electronic analog watch provided with a pager configured as described above, the time information outputted by the time measuring means is displayed by the hands of the analog display means. Upon reception of an individual call signal, however, the output signal of the external inputting means or the timer means is inputted to the display switching means. Then, the display switching means switches the time information to pager information such as a caller identification number or a telephone number stored in the received information storing means. Therefore, the received pager information can be inputted to the analog display means and displayed by the hand of the analog display means.

When continuous digits such as a telephone number are selected in sequence by the output signals of the external inputting means or the timer means, continuous digits are inputted in sequence to the analog display means, so that these digits can be displayed by the hand of the analog display means in sequence.

Further, in the electronic analog watch provided with a pager in which the output signal of the received information is displayed by the pager information analog display means, when an individual call signal is received, numerical or other indicia representative of the received call is displayed by the pager hand of the pager analog display means different from the analog display means for displaying the time information of the time measuring means.

DETAILED DESCRIPTION OF THE PREFERRED EMBODIMENTS

Embodiments of the present invention will be described hereinbelow with reference to the attached drawings.

(1) First Embodiment

Figure 1:
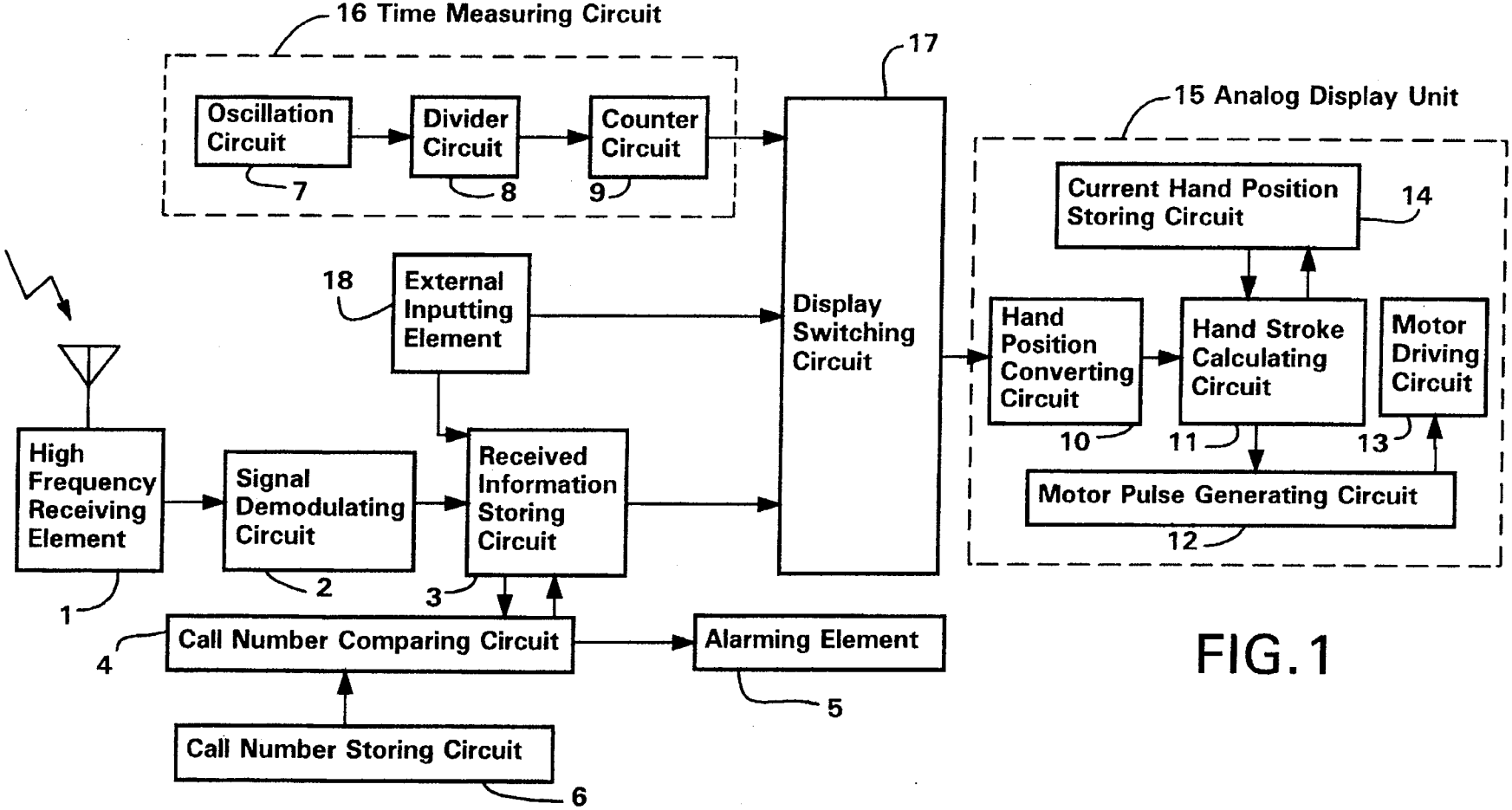
FIG. 1 is a system block diagram showing the first embodiment of the electronic analog watch provided with a pager according to the present invention.

FIG. 1 is a system block diagram showing a first embodiment of the electronic analog watch provided with a pager according to the present invention. In the drawing, a time measuring circuit 16 is composed of an oscillation circuit 7, a divider circuit 8 and a counter circuit 9. The output signal of the oscillation circuit 7 is divided into a specific frequency by the divider circuit 8. The output signal of the divider circuit 8 is inputted to the counter circuit 9 to count time, so that the time measuring circuit 16 can output time information.

An analog display element 15 is composed of a hand position converting circuit 10 for inputting the output signal of a display switching circuit 17, a hand stroke calculating circuit 11 for calculating a hand stroke on the basis of the output signal of a current hand position storing circuit 14 and the output signal of the hand position converting circuit 10, a motor pulse generating circuit 12 for generating a motor driving signal on the basis of the output signal of the hand stroke calculating circuit 11, and a motor driving circuit 13 for driving a hand on the basis of the output signal of the motor pulse generating circuit 12.

Here, the case will be explained where the time information outputted by the time measuring circuit 16 is in units of seconds, and the hand for analog display is a second hand. The time information is converted into an absolute angular position of the second hand by the hand position converting circuit 10. If the time information is now 5 seconds and further the second hand rotates one revolution (360 degrees) through 60 steps, the absolute position of the second hand is given as "5." Here, the current absolute position of the second hand calculated by the hand stroke calculating circuit 11 and further stored in the current hand position storing circuit 14 is 4 seconds in this case. Therefore, a relative hand stroke "1" can be obtained on the basis of the stored hand position "4" stored by the current hand position storing circuit 14 and the absolute position "5" converted by the hand position converting curcuit 10. Further, at this time, the information stored in the current hand position storing circuit 14 is updated to "5". Further, the output data "1" of the hand stroke calculating circuit 11 is inputted to the motor pulse generating circuit 12 to generate a motor pulse for driving the second hand by one step. Therefore, the second hand is driven by a motor via the motor driving circuit 13 by one step to the succeeding position of "5" second. The time information thus obtained can be displayed by the hand in an analog manner as described above.

A high frequency receiving element 1 receives a call signal and then outputs the received call signal to a signal demodulating circuit 2. The received call signal is demodulated by the signal demodulating circuit 2 into a digital signal, and then stored in a received information storing circuit 3. A call number comparing circuit 4 compares the received call signal now stored in the received information storing circuit 3 with call numbers previously stored in a call number storing circuit 6. When the received call signal matches any one of the stored call numbers, the call number comparing circuit 4 outputs a match signal to an alarming element 5, so that the alarming element 5 informs the user of the call reception by sound, light, vibration, etc.

After the call signal has been received, the signal inputted to the hand position converting circuit 10 via the display switching circuit 17 is switched from the output signal of the time measuring circuit 16 to the output signal of the received information storing circuit 3, by an external inputting element 18.

Figure 7:
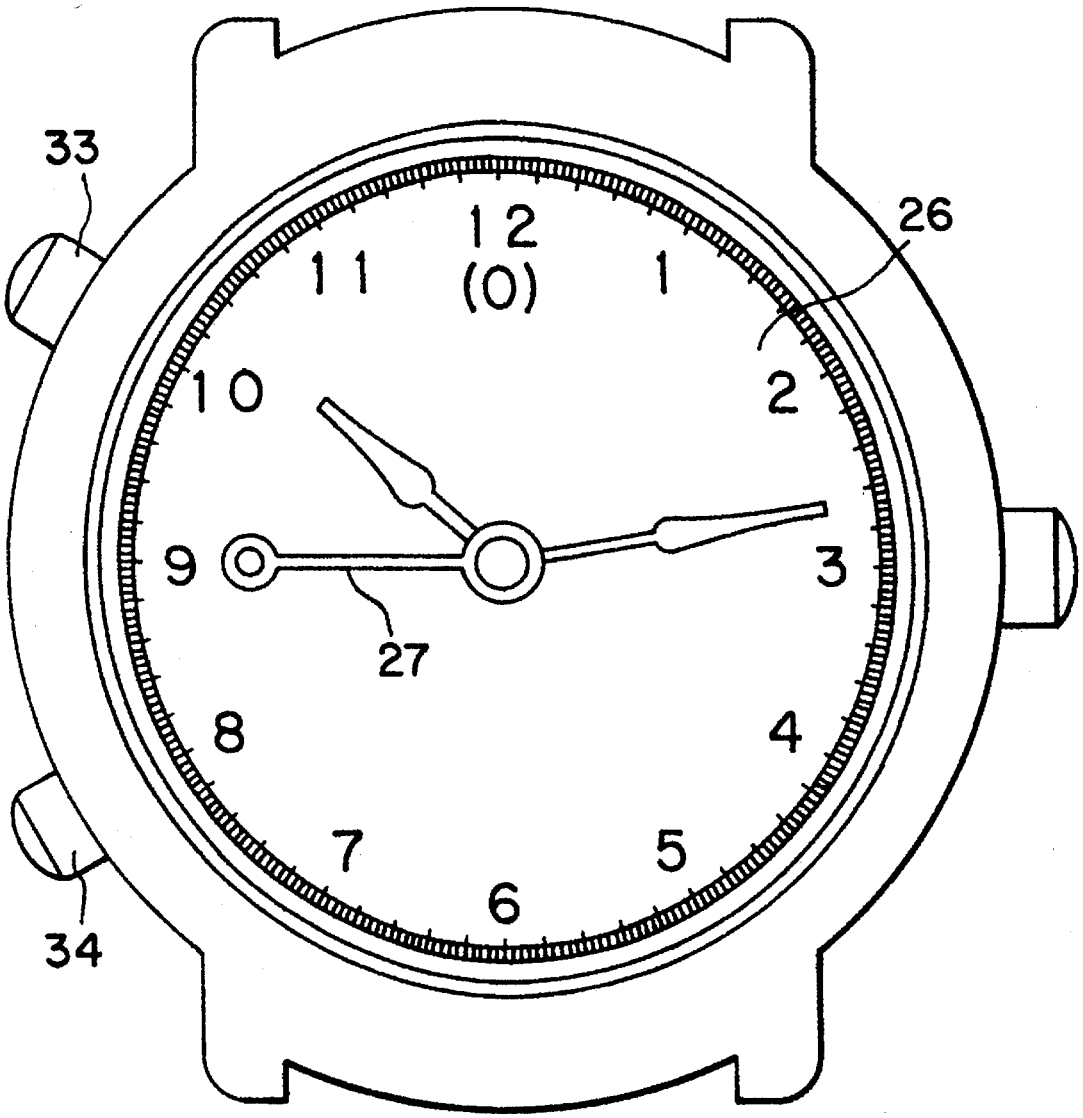
FIG. 7 is an external appearance view showing the first, second, third and fourth embodiments of the electronic analog watch provided with a pager according to the present invention.
Figure 8:
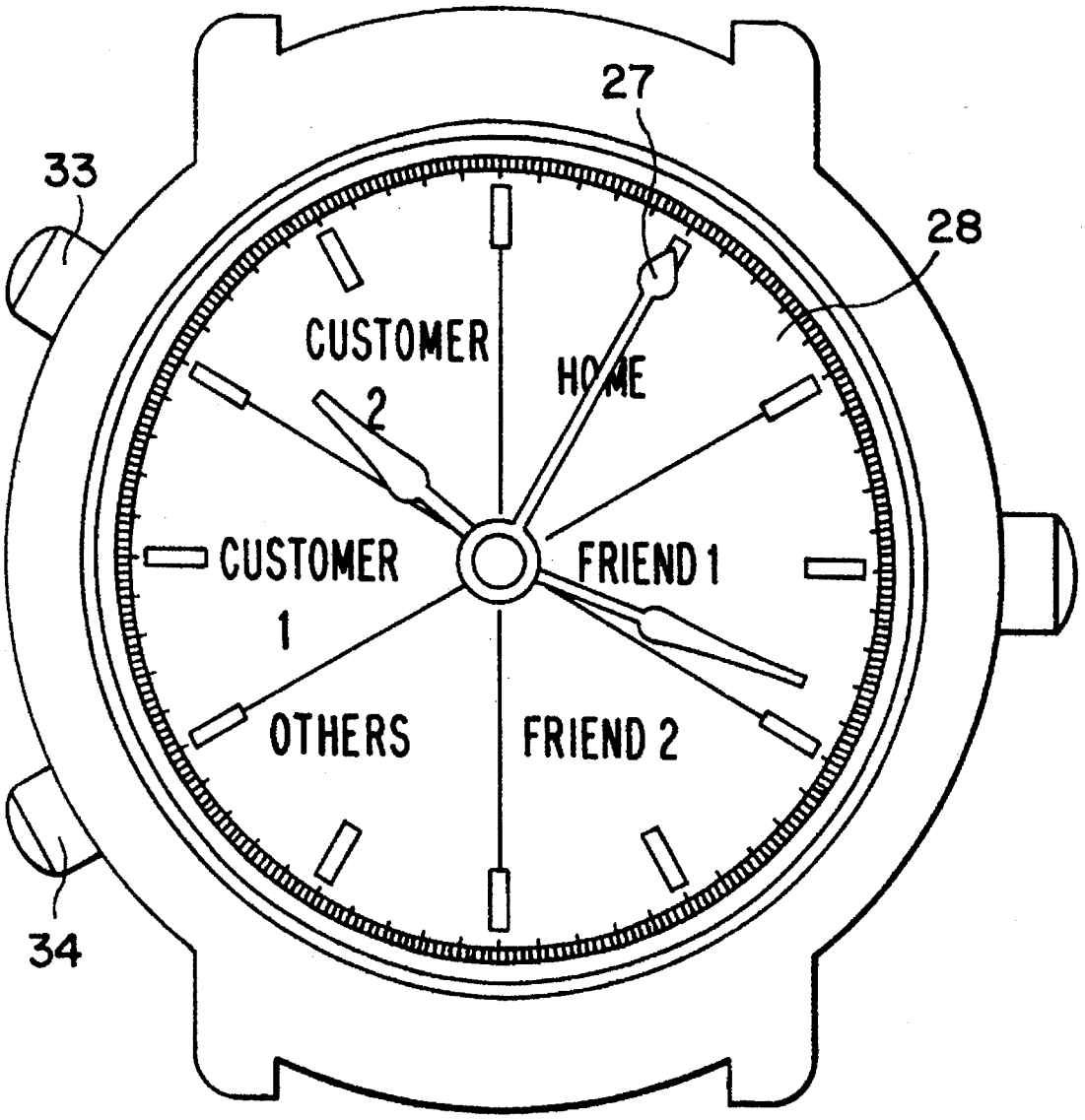
FIG. 8 is an external appearance view showing the first, second, third and fourth embodiments of the electronic analog watch provided with a pager according to the present invention.
Figure 9:
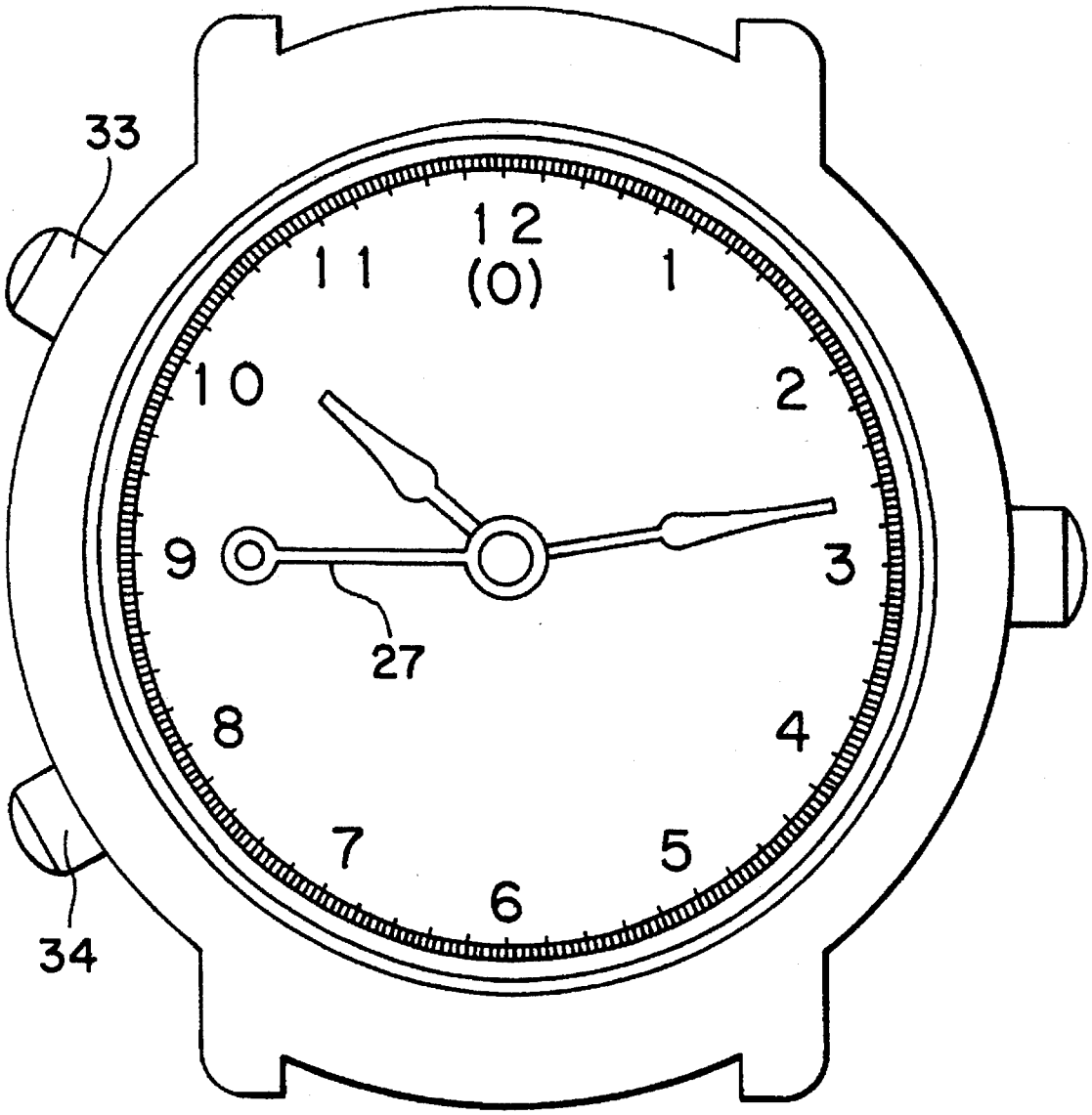
FIG. 9 is an external appearance view showing the first, second, third and fourth embodiments of the electronic analog watch provided with a pager according to the present invention.
Figure 10:
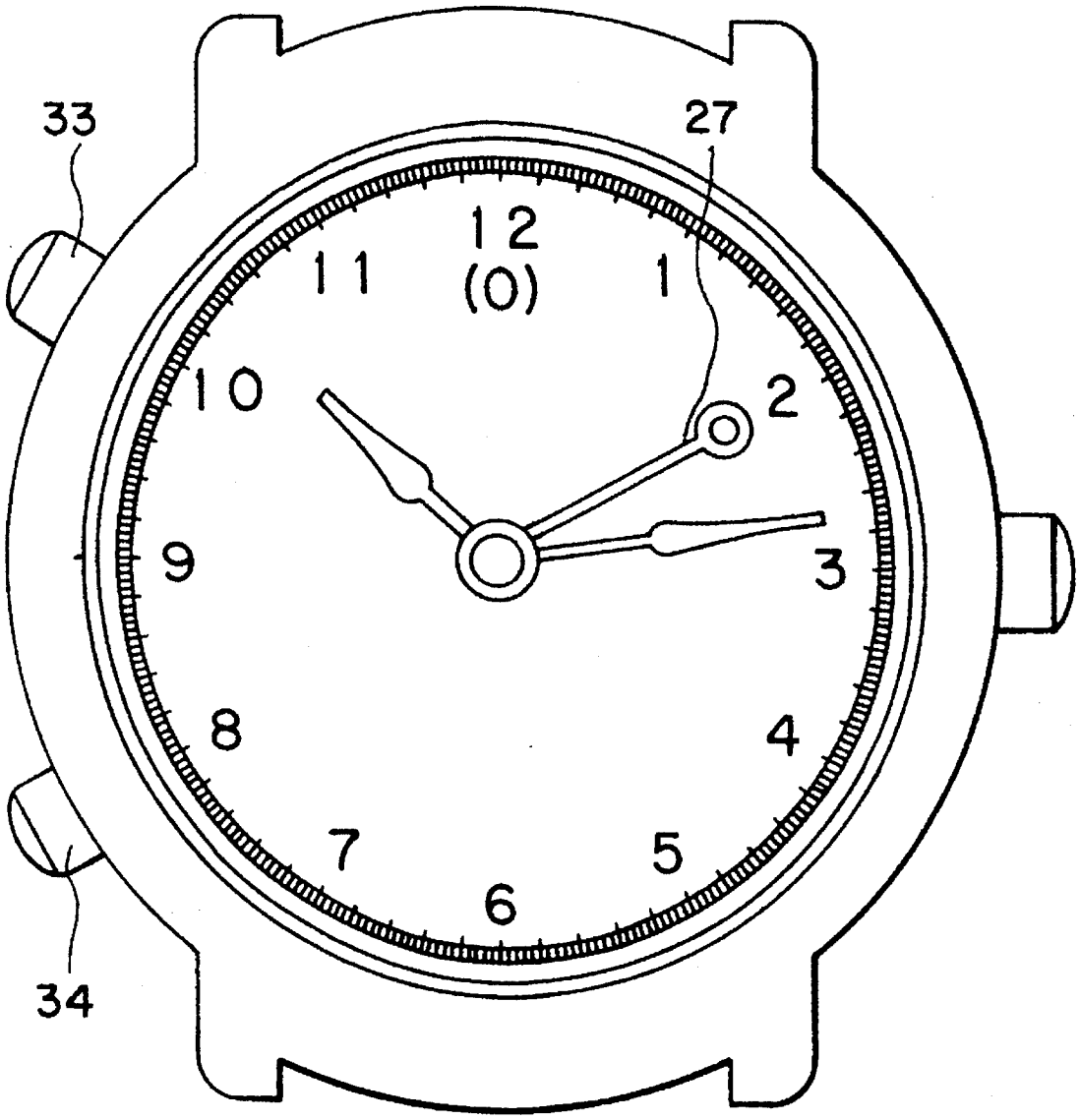
FIG. 10 is an external appearance view showing the first, second, third and fourth embodiments of the electronic analog watch provided with a pager according to the present invention.
Figure 11:
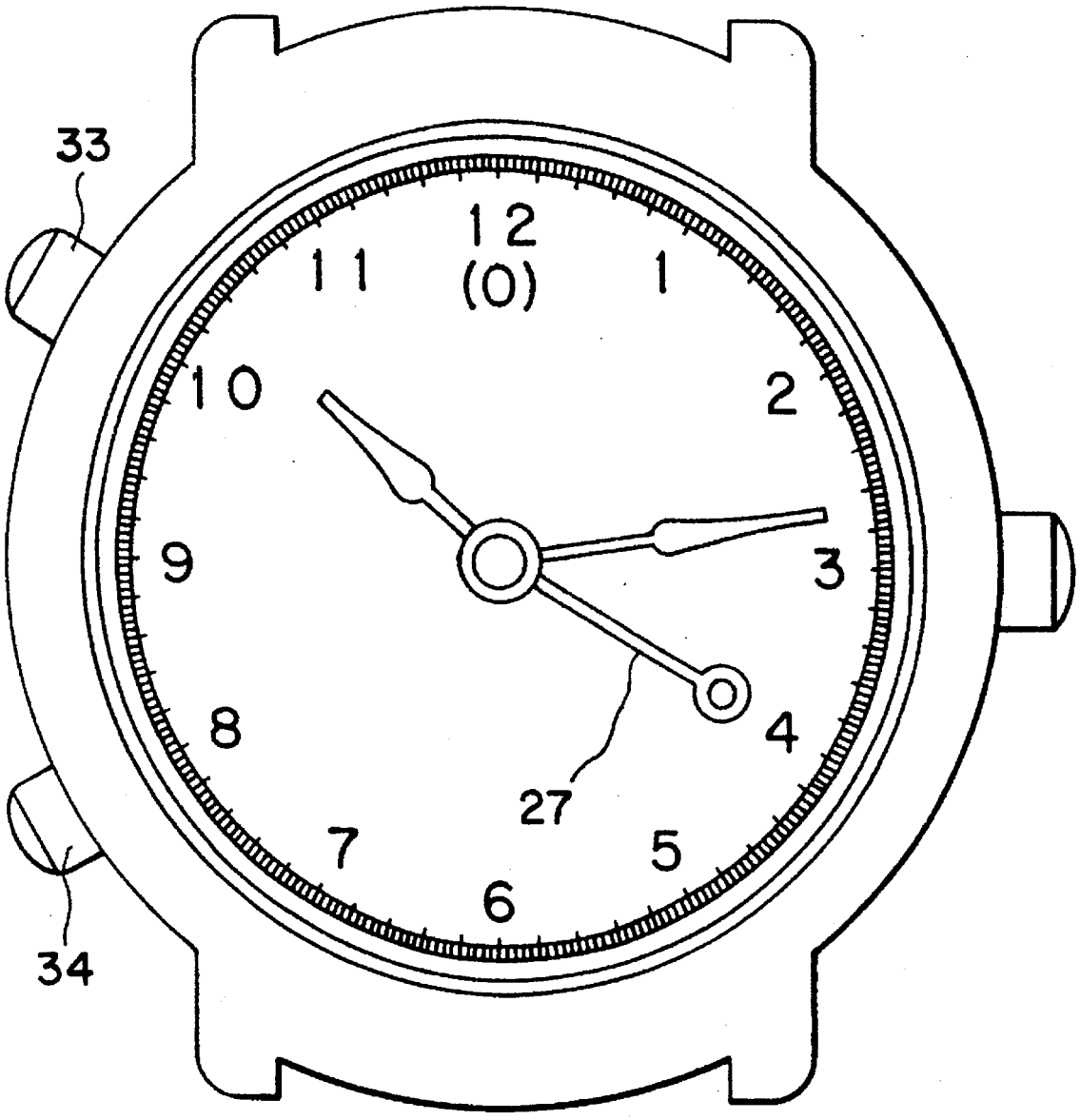
FIG. 11 is an external appearance view showing the first, second, third and fourth embodiments of the electronic analog watch provided with a pager according to the present invention.
Figure 12:
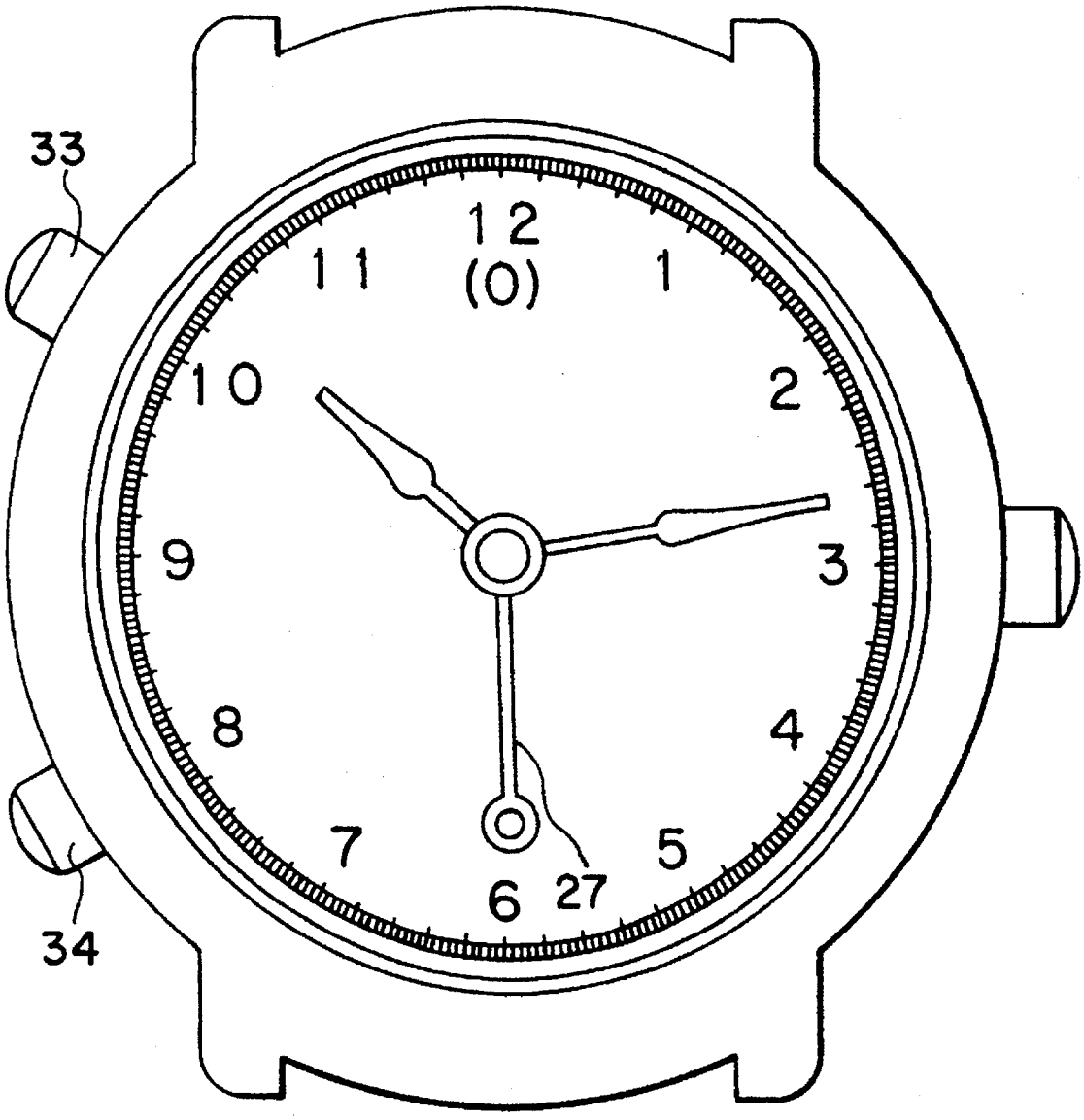
FIG. 12 is an external appearance view showing the first, second, third and fourth embodiments of the electronic analog watch provided with a pager according to the present invention.

FIGS. 7 and 8 are external appearance views showing first, second and third embodiments of the electronic analog watch provided with a pager according to the present invention.

In FIG. 7, where the received signal is an identification number of a call signal originating person, the user can identify the caller by seeing a digital mark on a digit dial 26 pointed to by a pager information indicating hand 27 (the second hand in this embodiment).

Further, as shown in FIG. 8, it is also possible to directly identify the caller, when characters or symbols for identifying callers are printed on an identify mark dial 28.

Where the received signal is a continuous digit signal such as a telephone number of a caller, the received information stored in the received information storing circuit 3 are inputted in sequence to the hand position converting circuit 10 via the display switching circuit 17 on the basis of the output signals applied by the external inputting element 18, in such a way that continuous digits of "9", "2", "4" and "6" can be displayed in sequence by the analog display unit 15 as shown in FIGS. 9, 10, 11 and 12.

Further, in this embodiment, although numerals or other indicia representative of the received information are pointed to by the second hand, the hand for pointing to indicia of the received information is not limited to only the second hand.

(2) Second Embodiment

Figure 2:
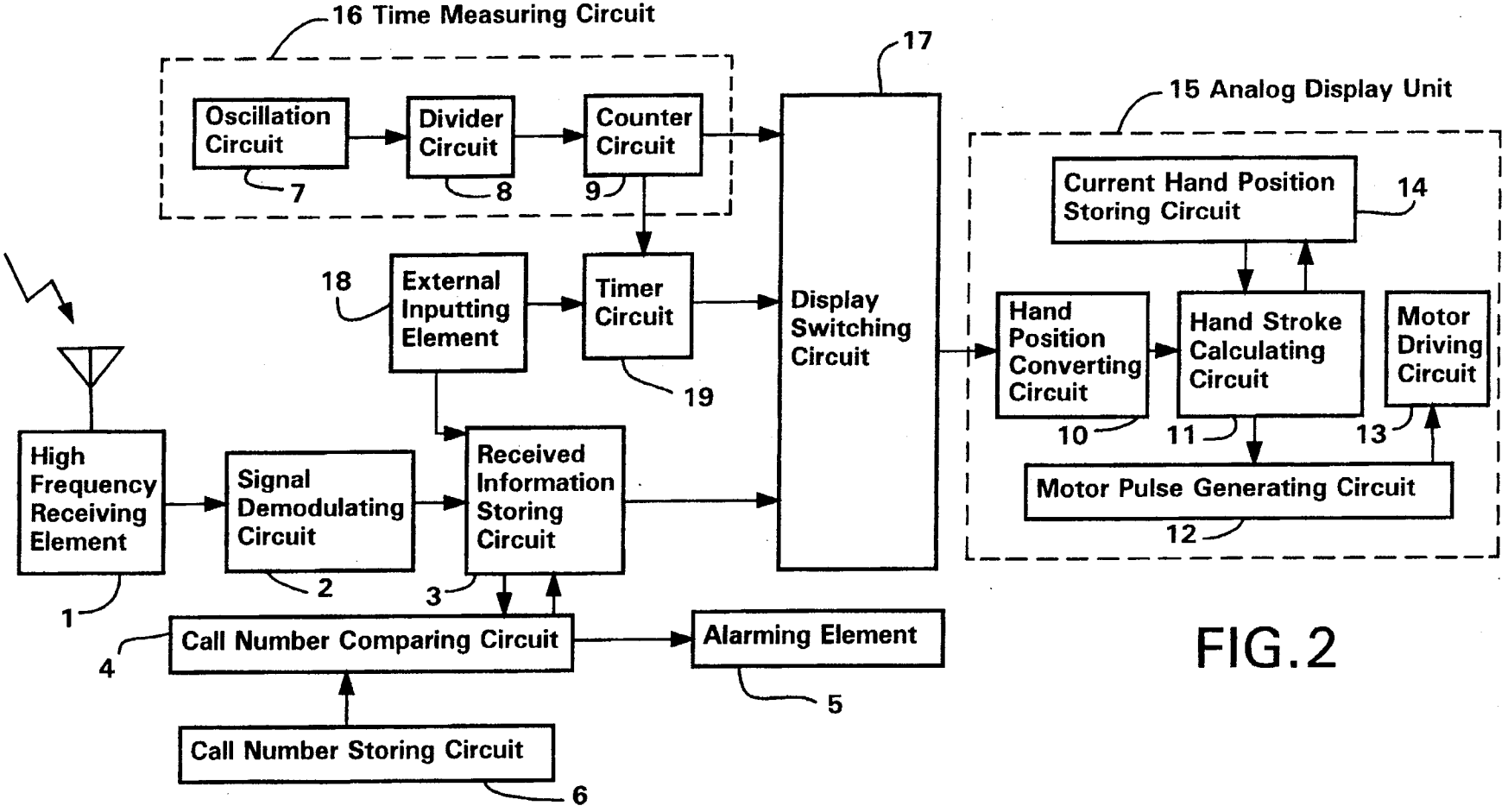
FIG. 2 is a system block diagram showing the second embodiment of the electronic analog watch provided with a pager according to the present invention.

FIG. 2 is a block diagram showing a second embodiment of the electronic analog watch provided with a pager according to the present invention.

In FIG. 2, in response to a signal of the external inputting element 18, a timer circuit 19 starts operation to input the output signals of the time measuring circuit 16 in sequence. The inputted time signals are inputted to the display switching circuit 17 and the received information storing circuit 3 at constant time intervals.

When the call signal is received and the timer operation starts, the display switching circuit 17 receives the output signals of the timer circuit 19, and switches the output signal outputted to the hand position converting circuit 10 from the time signal of the time measuring circuit 16 to the received paging information of the received information storing circuit 3, so that the received information can be displayed by the analog display unit 15.

In this case, when the received signal is a continuous digit signal such as a telephone number of the caller, the received information stored in the received information storing circuit 3 is inputted in sequence to the hand position converting circuit 10 via the display switching circuit 17 on the basis of the timer signal applied by the timer circuit 17, so that it is possible to display the continuous digits as shown by FIGS. 9, 10, 11 and 12.

(3) Third Embodiment

Figure 3:
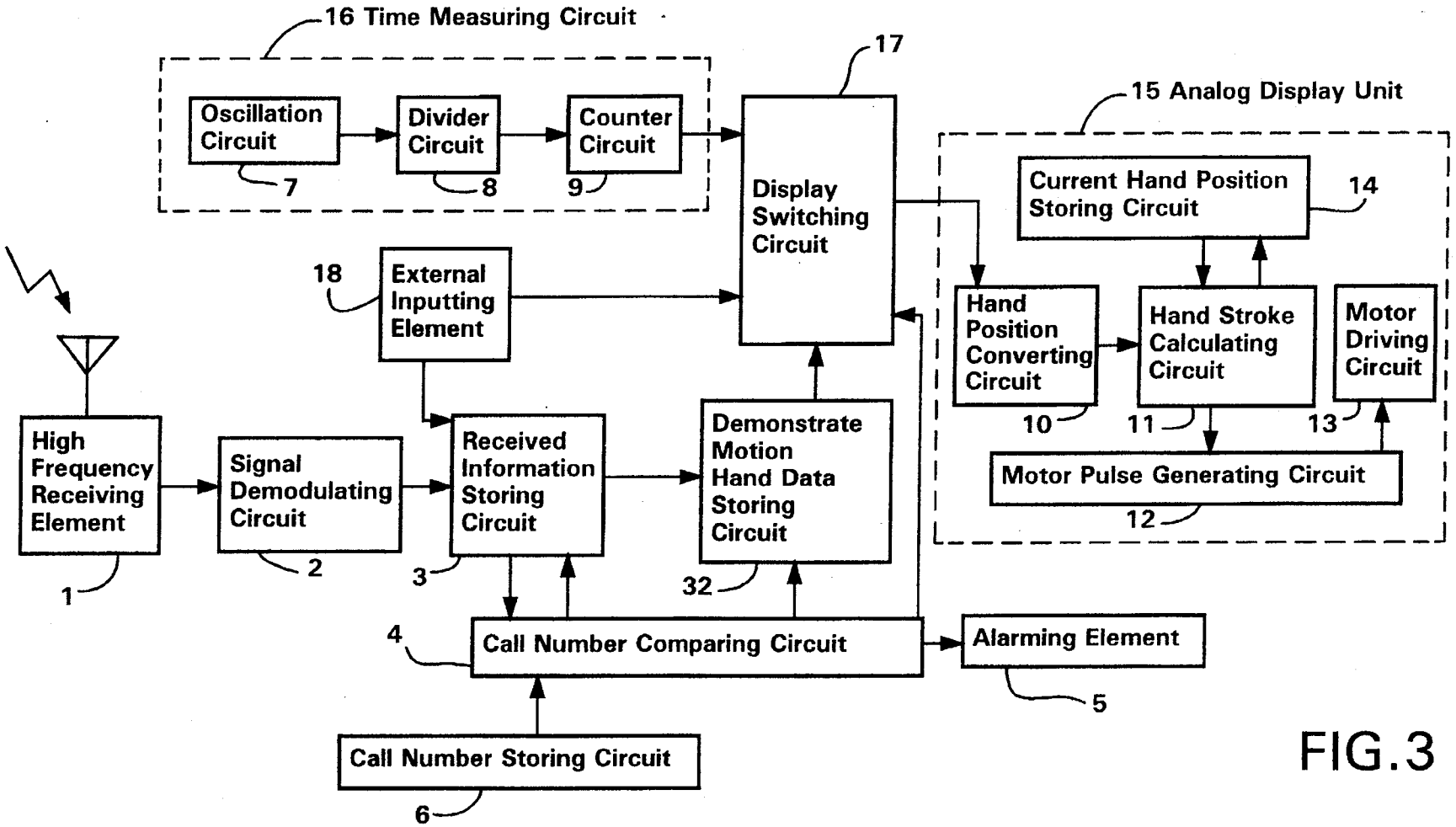
FIG. 3 is a system block diagram showing the third embodiment of the electronic analog watch provided with a pager according to the present invention.

FIG. 3 is a block diagram showing a third embodiment of the electronic analog watch provided with a pager according to the present invention.

Figure 13:
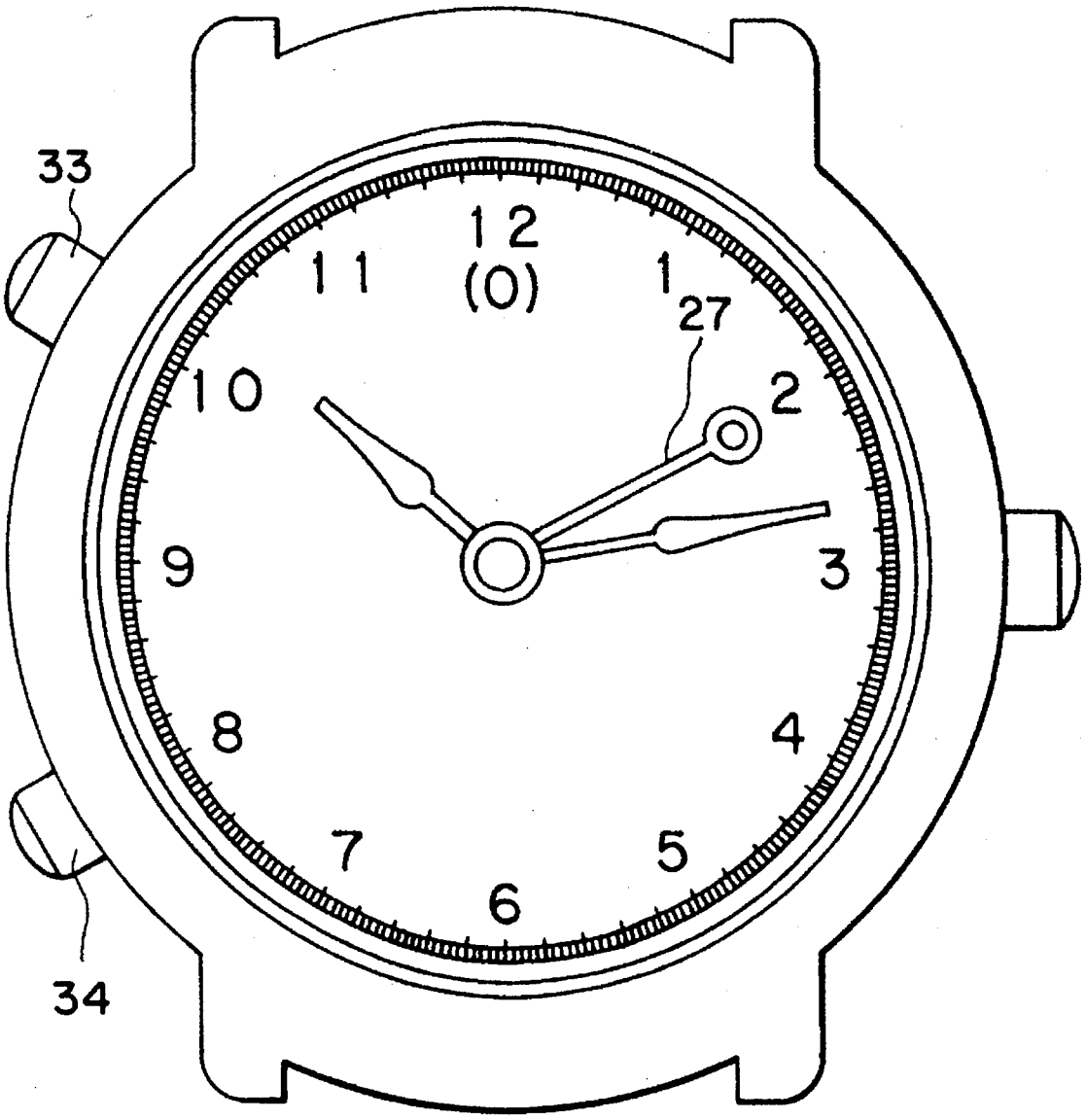
FIG. 13 is an external appearance view showing the first, second, third and fourth embodiments of the electronic analog watch provided with a pager according to the present invention.

FIG. 13 is an external appearance view showing the third and fourth embodiments of the electronic analog watch provided with a pager according to the present invention.

In FIG. 3, the call number comparing circuit 4 compares the received call signal stored in the received information storing circuit 3 with the call numbers previously stored in the call number storing circuit 6. When the received call signal matches any one of the stored call numbers, the call number comparing circuit 4 outputs a match signal to an alarming element 5, so that the alarming element 5 informs the user of the call reception by sound, light, vibration, etc. Further, a demonstrate motion hand data storing circuit 32 stores demonstrate motion hand data for allowing the pager information indicating hand 27 shown in FIG. 13 to be moved in a specific manner, after the alarm has been generated. This specific motion of the pager information hand is such that the hand is oscillated plural steps by plural steps on both sides with the 12 o'clock position as its center, for instance.

Further, in this demonstrate motion hand data storing circuit 32, the demonstrate motion hand data are formed and stored therein on the basis of the memory numbers indicative of the ordinal numbers of the received information data stored in the received information storing circuit 3. Therefore, if the received signal is the second received signal, for instance, the second memory number data is stored together in the demonstrate motion hand storing circuit 32. In other words, the demonstrate motion hand data are stored on the basis of the second memory number. The examples of the demonstrate motion hand data are as follows: the pager information hand 27 first indicates the memory number 2 at 2 o'clock position and then rotates by 60 steps with the 2 o'clock position as its center to sequentially display the received information, or the pager information hand 27 first indicates the memory number at 2 o'clock position and then oscillates plural steps by plural steps on both sides with the 2 o'clock position as its center for sequentially displaying the received information.

Further, a switch SWB 34 shown in FIG. 13 is the external inputting element 18 for changing the memory numbers to select the received information so far received and stored. Here, when the newly received signal is the second signal and further this switch SWB 34 is depressed, the latest memory number 2 is indicated by the demonstrate motion hand at 2 o'clock position, and the hand rotates 60 steps by 60 steps with this 2 o'clock position as its center repeatedly to sequentially display the received information. When the switch SWB 34 is further depressed again, the pager information indicating hand 27 shifts to the 1 o'clock position to indicate the memory number 1. In this case, if the received information of memory number 1 has been transferred even once from the received information storing circuit 3 to the analog display unit 15, the pager information hand 27 indicates the memory number 1 only at 1 o'clock position, without repeating the demonstrated motion. In other words, it is possible to know whether the received data selected by the memory number has been already read from the received information storing circuit 3 or not.

The switch SWA 33 is a key for reading the received information of the selected memory number in sequence. In the case where the received information signal stored by the received information storing circuit 3 is a continuous digit signal such as a telephone number, it is possible to display the continuous digits by the analog display unit 15, by depressing this switch SWA 33 in sequence to input the received information stored in the received information storing circuit 3 to the hand position converting circuit 10 via the received information display switching circuit 17, as shown in FIGS. 9, 10, 11 and 12.

(4) Fourth Embodiment

Figure 4:
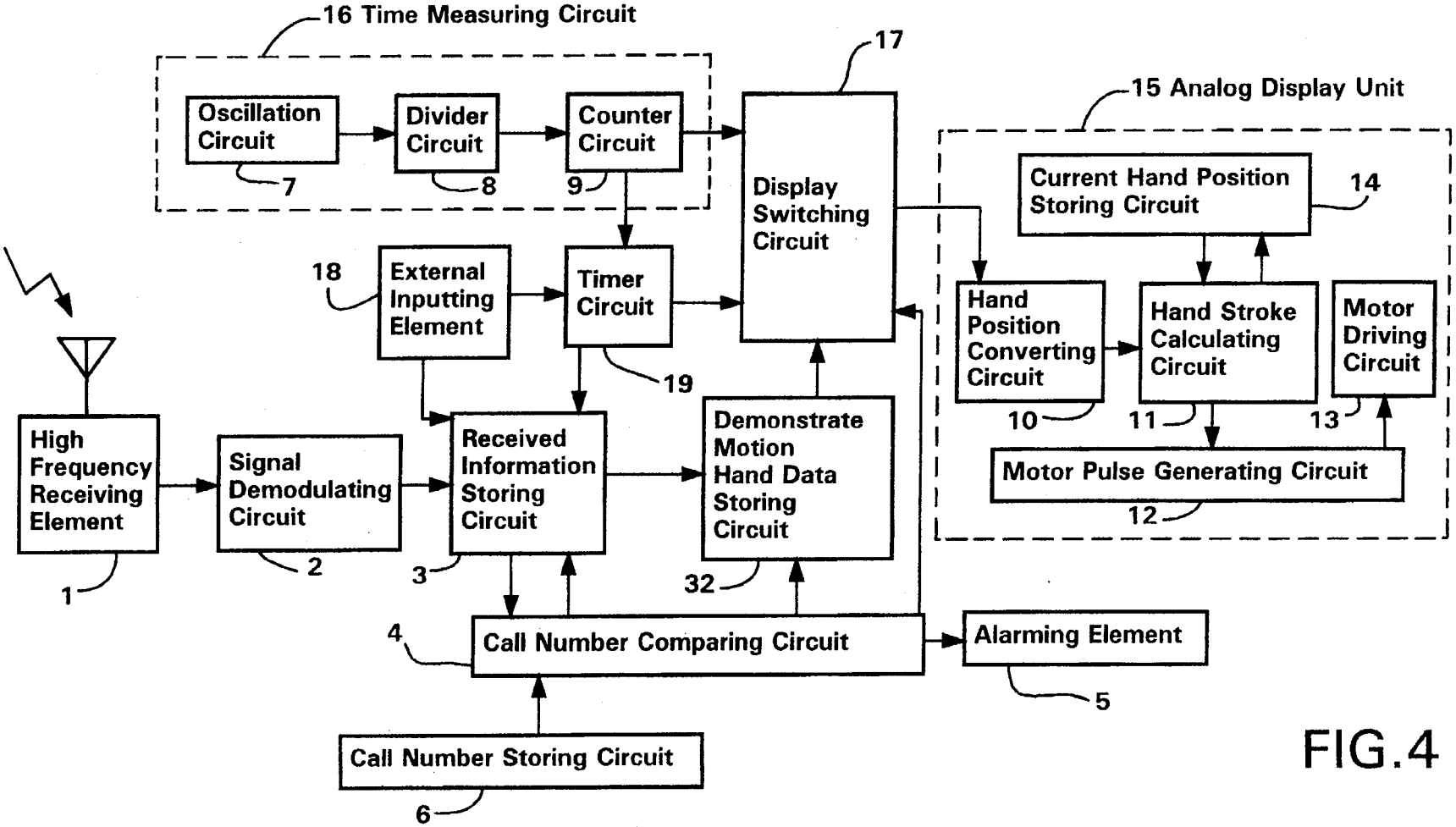
FIG. 4 is a system block diagram showing the fourth embodiment of the electronic analog watch provided with a pager according to the present invention.

FIG. 4 is a block diagram showing a fourth embodiment of the electronic analog watch provided with a pager according to the present invention.

In FIG. 4, in response to a signal of the external inputting element 18, a timer circuit 19 starts operation to input the output signals of the time measuring circuit 16. The inputted time signals are inputted to the display switching circuit 17 and the received information storing circuit 3 at constant time intervals. In FIG. 4, when the received signal is a continuous digit signal such as a caller telephone number, on the basis of the timer signals outputted at regular time intervals from the timer circuit 19 (without depressing the switch SWA 33 of the external inputting element 18 as shown in FIG. 3), it is possible to display the received information stored in the received information storing circuit 3 by the analog display unit 15, by inputting the received information to the hand position converting circuit 10 via the received information display switching circuit 17, as shown in FIGS. 9, 10, 11 and 12.

(5) Fifth Embodiment

Figure 5:
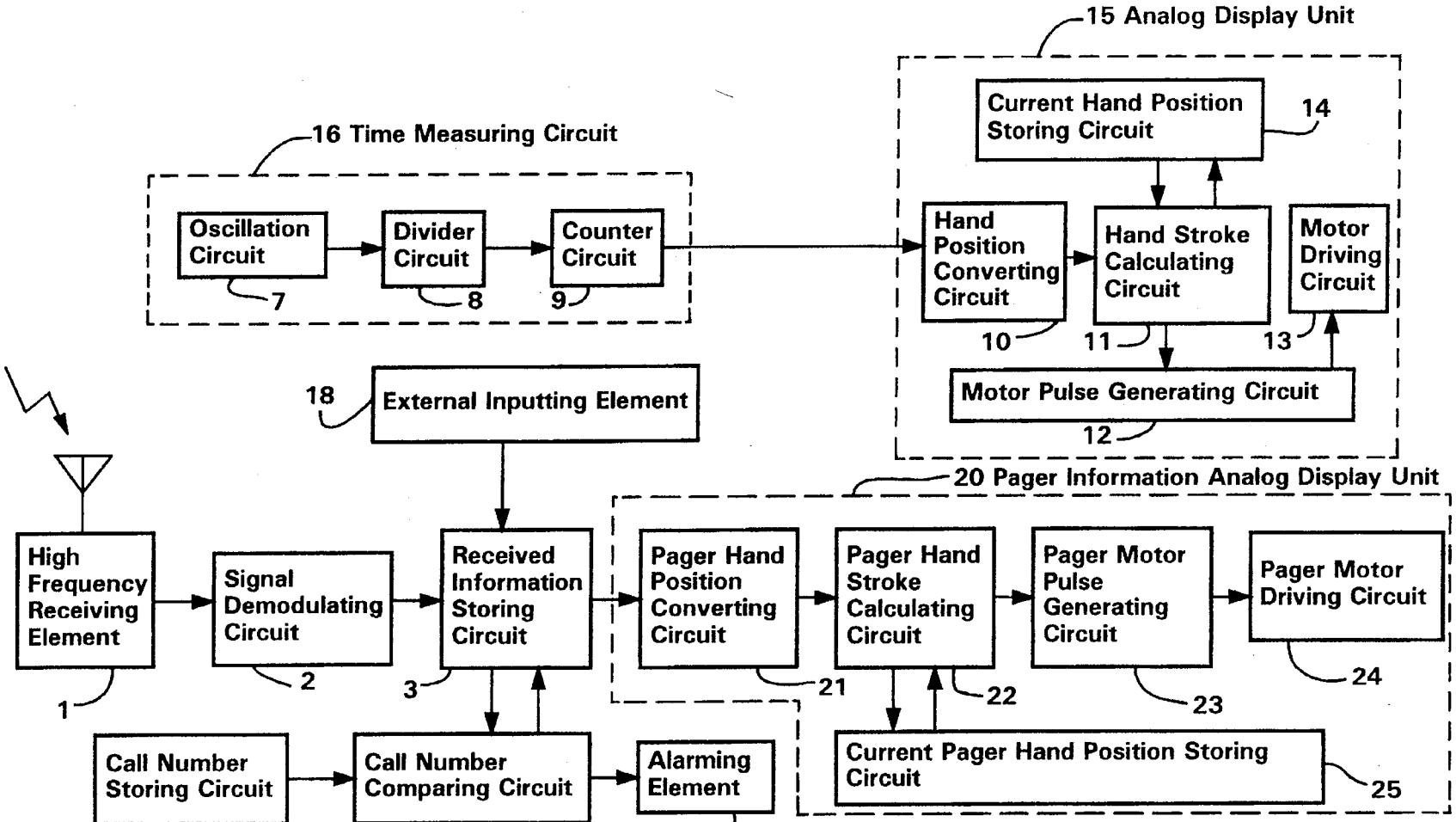
FIG. 5 is a system block diagram showing the fifth embodiment of the electronic analog watch provided with a pager according to the present invention.

FIG. 5 is a block diagram showing a fifth embodiment of the electronic analog watch provided with a pager according to the present invention.

In FIG. 5, the output of the time measuring circuit 16 is inputted to the analog display element 15 to display the time information in an analog manner.

On the other hand, the output of the received signal information storing means is inputted to the pager hand position converting circuit 21, to display the received information by the pager information analog display unit 20 different from the analog display unit 15 for displaying the time information.

Figure 14:
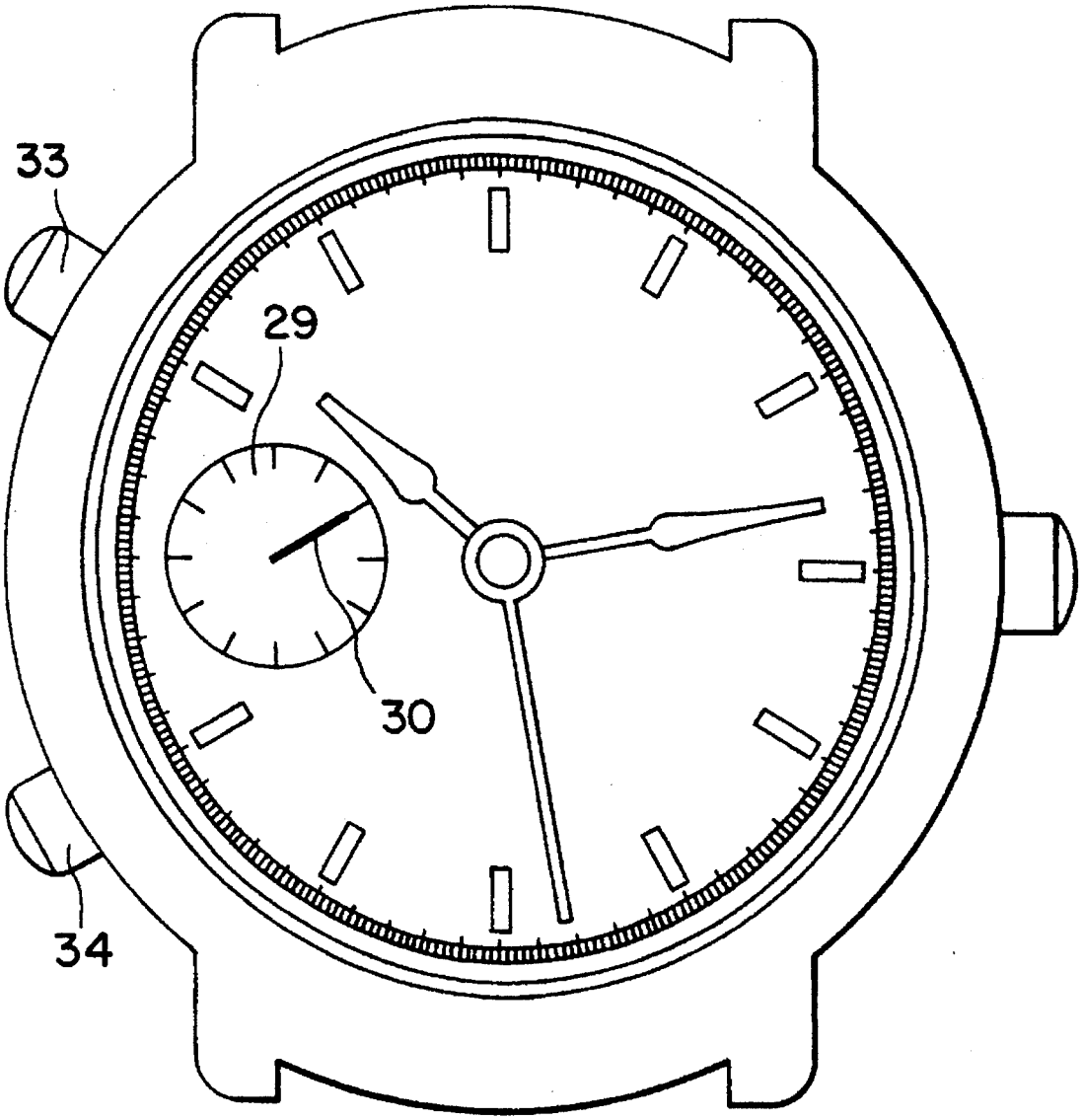
FIG. 14 is an external appearance view showing the fifth and sixth embodiments of the electronic analog watch provided with a pager according to the present invention.

FIG. 14 is an external appearance view showing the fifth and sixth embodiments of the electronic analog watch provided with a pager according to the present invention.

In FIG. 14, when the received signal is the identification number of the caller, it is also possible to directly identify the caller, by seeing a mark pointed by a pager display hand 30 on the dial 29.

In FIG. 5, when the received signal is a continuous digit signal such as a telephone number of the caller, the received information stored in the received information storing circuit 3 is inputted in sequence to the pager hand position converting circuit 21 on the basis of the output signal of the external inputting element 18, in order to display the continuous digits by the pager information display unit 20.

(6) Sixth Embodiment

Figure 6:
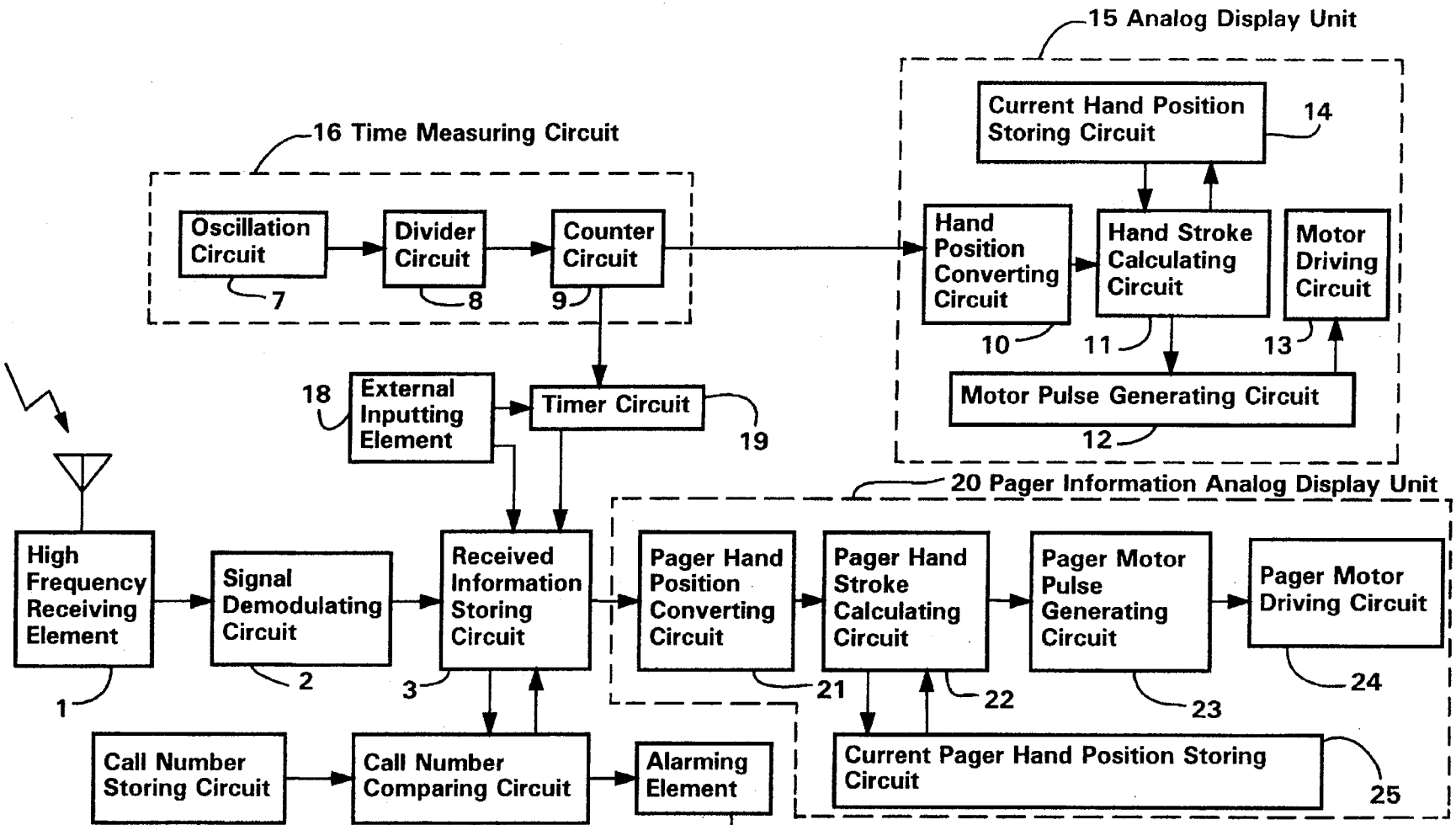
FIG. 6 is a system block diagram showing the sixth embodiment of the electronic analog watch provided with a pager according to the present invention.

FIG. 6 is a block diagram showing a sixth embodiment of the electronic analog watch provided with a pager according to the present invention.

In FIG. 6, in response to a signal of the external inputting element 18, a timer circuit 19 starts operation to input the output signals of the time measuring circuit 16. The inputted time signals are outputted to the received information storing circuit 3 at constant time intervals. When the received signal is a continuous digit signal such as a caller telephone number, on the basis of the signals outputted at regular time intervals from the timer circuit 19, it is possible to display the continuous digits, by inputting in sequence the received information stored in the received information storing circuit 3 to the pager information converting circuit 21.

Figure 15:
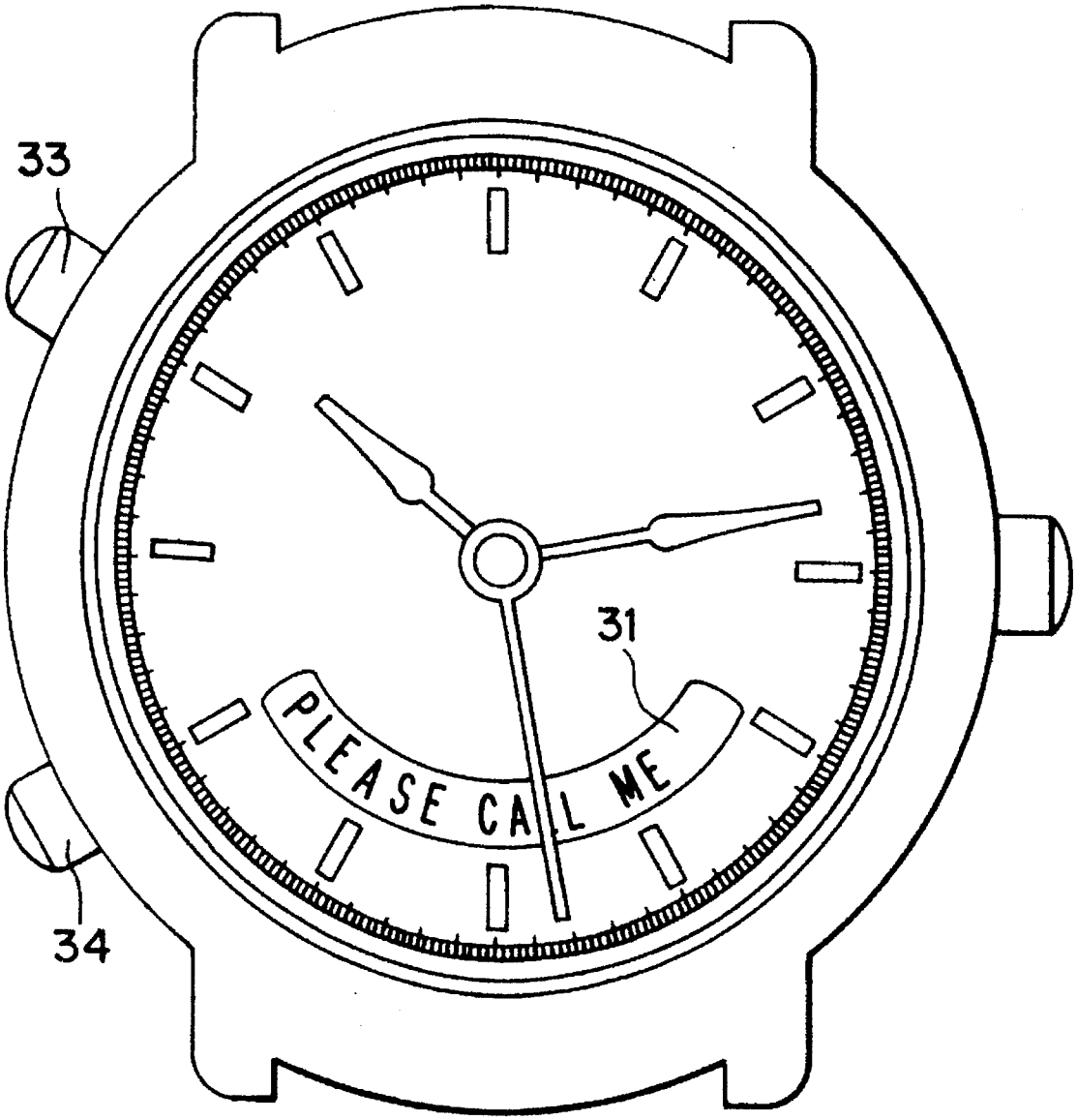
FIG. 15 is an external appearance view showing the fifth and sixth embodiments of the electronic analog watch provided with a pager according to the present invention.
Figure 16:
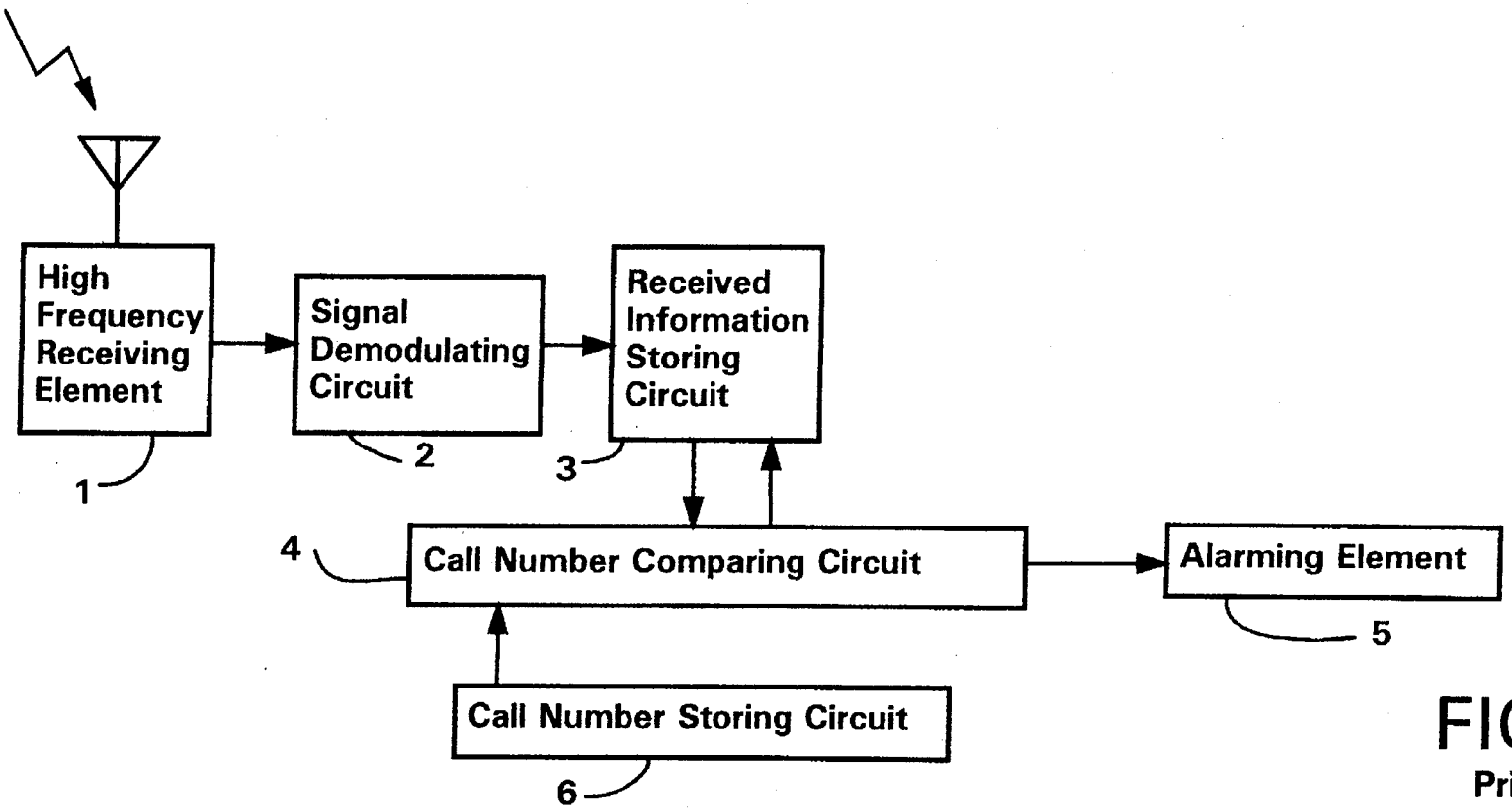
FIG. 16 Prior Art
FIG. 16 is a system block diagram showing a prior art pager.

Further, if the received information is a determined information expression, it is possible to display it on a date indicator 31 as shown in FIG. 15.

As described above, in the present invention, in response to the output signal of the external inputting means or the timer means, the display switching means selectively switches the time signal outputted by the time measuring means to the received information signal outputted by the received information storing means. Further, the output signals of the display switching means are inputted to the analog display means. Accordingly, there exists such an effect as to provide an analog watch excellent from the standpoints of design and fashion, which can display both the caller identification number and the message (e.g., a telephone number) in analog display.

In addition, the same effect as above can be obtained by inputting the output signal of the external inputting means or the timer means to the received information storing means to control the received information to be displayed. The output signal of the received information storing means is inputted to the pager information analog display means for displaying only the received information, without use of any display switching means.

What is claimed is:

1. An electronic analog watch provided with a pager, comprising: high frequency receiving means for receiving an individual call signal; signal demodulating means for demodulating the received individual call signal to produce a corresponding digital signal; received information storing means for storing a plurality of demodulated received individual call signals; call number storing means for storing a plurality of previously given individual call numbers; call number comparing means for comparing the received individual call signal with the previously given individual call numbers; hand data storing means for outputting a specific hand drive pattern data on the basis of an output signal of the received information storing means and an output signal of the call number comparing means; alarm means for generating an alarm when compared inputs of the call number comparing means match each other; time measuring means for measuring time; external inputting means for selecting information to be displayed; display switching means responsive to any one of an output signal of the external inputting means and an output signal of the call number comparing means for switching an output signal of the time measuring means, an output signal of the received information storing means, and an output signal of the hand data storing means; analog display means including a display hand for displaying information; display hand position converting means for converting an output signal of said display switching means to display hand position data for analog display; current display hand position storing means for storing current display hand position data; display hand stroke calculating means for calculating a stroke of the display hand to be displayed on the basis of an output signal of the display hand position converting means and an output signal of the current display hand position storing means; a motor for driving the display hand; motor pulse generating means for generating a motor driving pulse on the basis of an output signal of the display hand stroke calculating means; and motor driving means for driving the motor on the basis of an output signal of the motor pulse generating means.

2. An electronic analog watch provided with a pager according to claim 1; further including timer means for selecting information to be displayed on the basis of an output signal of the time measuring means.

3. An electronic analog watch provided with a pager according to claim 1; further including timer means for selecting information to be displayed on the basis of an output signal of the time measuring means.

4. An electronic analog watch provided with a pager according to claim 1; further comprising timer means for selecting information to be displayed on the basis of an output signal of the time measuring means, and wherein the external inputting means is effective for starting operation of the timer means.

5. An electronic analog watch provided with a pager according to claim 1; wherein the alarm means includes means for producing an output selected from the group consisting of an audible output, a light output, and a vibration output.

6. An electronic analog watch provided with a pager according to claim 1; wherein the received information signal is displayed sequentially by the analog display means.

7. An electronic analog watch provided with a pager according to claim 1; wherein the analog display means displays indicia representative of the received information signal.

8. An electronic analog watch provided with a pager according to claim 1; wherein received information is input in sequence to the display hand position converting means via the display switching means in accordance with an output of a timer.

9. An electronic analog watch provided with a pager according to claim 1; wherein the external inputting means comprises a manually operable switch means.

10. A timepiece provided with a pager, comprising: time measuring means for measuring time and producing an output signal in accordance therewith; pager means including receiving means for receiving high frequency paging signals, and demodulating means for demodulating the high frequency paging signals and producing a demodulated output signal; selecting means for selecting for display an output signal from one of the time measuring means and the paging means; means for converting the selected output signal into a driving signal for driving an analog display; received information storing means for storing received paging signals; call number storing means for storing a plurality of previously given call numbers; and analog display means, including a display hand, receptive of the driving signal for displaying the selected information, the analog display means further including display hand drive pattern storing means for storing predetermined display hand drive pattern data and for outputting a respective display hand drive pattern in accordance with an output signal of the received information storing means and an output signal of the call number comparing means.

11. A timepiece provided with a pager according to claim 10; further comprising call number comparing means for comparing respective individual call signals with the previously given individual call numbers.

12. A timepiece provided with a pager according to claim 10; further comprising alarm means for generating an alarm when inputs to the call number comparing means match each other.

13. A timepiece provided with a pager according to claim 12; wherein the selecting means comprises external inputting means for selecting information to be displayed and producing an output signal indicative of the selected information.

14. A timepiece provided with a pager according to claim 13; wherein the display means further comprises display switching means for selectively outputting an output signal of one of the time measuring means or the pager means in response to an output signal of the external inputting means.

15. A timepiece provided with a pager according to claim 14; wherein the display means further comprises display hand position converting means for converting an output signal of the display switching means to display hand position for display.

16. A timepiece provided with a pager according to claim 15; wherein the display means further comprises current display hand position storing means for storing a current display hand position.

17. A timepiece provided with a pager according to claim 16; wherein the display means further comprises display hand stroke calculating means for calculating a stroke by which the display hand is to be driven in accordance with an output signal of the display hand position converting means and an output signal of the current hand position storing means.

18. A timepiece provided with a pager according to claim 17; wherein the display means further comprises a motor for driving the display hand.

19. A timepiece provided with a pager according to claim 18; wherein the display means further comprises motor pulse generating means for generating a motor driving pulse in accordance with an output signal of the hand stroke calculating means.

20. A timepiece provided with a pager according to claim 19; wherein the display means further comprises motor driving means for driving the motor in accordance with an output signal of the motor pulse generating means.

21. A timepiece provided with a pager according to claim 10; wherein the selecting means comprises timer means for selecting information to be displayed in accordance with an output signal of the time measuring means, and external inputting means for starting operation of the timer means.

22. A timepiece provided with a pager according to claim 21; wherein the display means further comprises display switching means for selectively outputting one of an output signal of the time measuring means and an output signal of the paging means in accordance with an output signal of the timer means.

23. A timepiece provided with a pager according to claim 10; wherein the display means further comprises display switching means responsive to any one of an output signal of the selecting means and an output signal of the call number comparing means for selectively displaying one of an output signal of the time measuring means, an output signal of the received information storing means and an output signal of the display hand drive pattern data storing means.

24. An electronic analog watch provided with a pager, comprising: high frequency receiving means for receiving an individual call signal; signal demodulating means for demodulating the received individual call signal to produce a corresponding digital signal; received information storing means for storing a plurality of demodulated received individual call signals; call number storing means for storing a plurality of previously given individual call numbers; call number comparing means for comparing the received individual call signal with the previously given individual call numbers; alarm means for generating an alarm when compared inputs of the call number comparing means match each other; time measuring means for measuring time; external inputting means for selecting information to be displayed; display switching means for selectively outputting one of an output signal of the time measuring means and an output signal of the received information storing means in accordance with an output signal of the external inputting means; analog display means including a display hand for displaying information; display hand position converting means for converting an output signal of the display switching means to display hand position data for analog display; current display hand position storing means for storing current display hand position data; display hand stroke calculating means for calculating a stroke of the display hand to be displayed on the basis of an output signal of the display hand position converting means and an output signal of the current display hand position storing means; a motor for driving the display hand; motor pulse generating means for generating a motor driving pulse on the basis of an output signal of the display hand stroke calculating means; and motor driving means for driving the motor on the basis of an output signal of the motor pulse generating means; wherein the display hand first displays a numeral indicating which number of a plurality of messages it is currently displaying.

25. An electronic analog watch provided with a pager, comprising: high frequency receiving means for receiving an individual call signal; signal demodulating means for demodulating the received individual call signal to produce a corresponding digital signal; received information storing means for storing a plurality of demodulated received individual call signals; call number storing means for storing a plurality of previously given individual call numbers; call number comparing means for comparing the received individual call signal with the previously given individual call numbers; alarm means for generating an alarm when compared inputs of the call number comparing means match each other; time measuring means for measuring time; external inputting means for selecting information to be displayed; display switching means operative in response to a received paging signal for selectively outputting one of an output signal of the time measuring means and an output signal of the received information storing means in accordance with an output signal of the external inputting means; analog display means including a display hand for displaying information; display hand position converting means for converting an output signal of the display switching means to display hand position data for analog display; current display hand position storing means for storing current display hand position data; display hand stroke calculating means for calculating a stroke of the display hand to be displayed on the basis of an output signal of the display hand position converting means and an output signal of the current display hand position storing means; a motor for driving the display hand; motor pulse generating means for generating a motor driving pulse on the basis of an output signal of the display hand stroke calculating means; and motor driving means for driving the motor on the basis of an output signal of the motor pulse generating means.

* * * * *

UNITED STATES PATENT AND TRADEMARK OFFICE

CERTIFICATE OF CORRECTION

PATENT NO. : 5,572,196

DATED : November 5, 1996

INVENTOR(S) : Kazumi SAKUMOTO and Fujio OZAWA

It is certified that error appears in the above-indentified patent and that said Letters Patent is hereby corrected as shown below:

On the Title page, item [73] insert:

--Assignee: Seiko Instruments Inc.--.

Signed and Sealed this

Eighteenth Day of February, 1997

*Attest:*

*Attesting Officer*

Bruce Lehman

BRUCE LEHMAN

*Commissioner of Patents and Trademarks*